US010307652B2

(12) United States Patent
Moy

(10) Patent No.: US 10,307,652 B2
(45) Date of Patent: Jun. 4, 2019

(54) CLIMBING HOLD ASSEMBLY HAVING LOAD DISSIPATIVE EFFECT

(71) Applicant: Russell I. Moy, Leesburg, VA (US)

(72) Inventor: Russell I. Moy, Leesburg, VA (US)

( * ) Notice: Subject to any disclaimer, the term of this patent is extended or adjusted under 35 U.S.C. 154(b) by 0 days.

(21) Appl. No.: 15/227,170

(22) Filed: Aug. 3, 2016

(65) Prior Publication Data

US 2016/0339317 A1 Nov. 24, 2016

Related U.S. Application Data

(63) Continuation of application No. 14/261,569, filed on Apr. 25, 2014, now Pat. No. 9,427,647.

(60) Provisional application No. 61/816,246, filed on Apr. 26, 2013.

(51) Int. Cl.
*A63B 69/00* (2006.01)

(52) U.S. Cl.
CPC ..... *A63B 69/0048* (2013.01); *A63B 2209/00* (2013.01)

(58) Field of Classification Search
CPC .. A63B 69/0048; A63B 2209/00; A63B 29/08
See application file for complete search history.

(56) References Cited

U.S. PATENT DOCUMENTS 5,732,954 A 3/1998 Strickler et al.
D427,047 S 6/2000 Franklin
6,074,327 A 6/2000 Franklin
6,514,178 B2 2/2003 Vettori
6,540,645 B1 4/2003 Zeilinger
D478,145 S 8/2003 Byrd et al.
6,709,365 B2 3/2004 Zeilinger
6,942,600 B2 9/2005 Zeilinger
7,056,266 B2 6/2006 Sudeith
7,250,020 B2 7/2007 Barbafieri et al.
7,419,457 B1 9/2008 Sudeith et al.
7,520,837 B1 4/2009 Sudeith et al.
7,520,838 B1 4/2009 Sudeith et al.
7,524,269 B2 4/2009 Postma et al.
7,594,874 B2 9/2009 Meissner
7,611,444 B1 11/2009 Sudeith
8,038,581 B1 10/2011 Sudeith
2005/0109559 A1 5/2005 Eike
2005/0233863 A1* 10/2005 Zeilinger ..... A63B 69/0048 482/37
2005/0245355 A1 11/2005 Brewer et al.
2007/0191188 A1 8/2007 Collins
2007/0240281 A1 10/2007 Meissner
2011/0319230 A1 12/2011 Brendle

* cited by examiner

*Primary Examiner* — Megan Anderson
(74) *Attorney, Agent, or Firm* — Leveque IP Law, P.C.

(57) ABSTRACT

A climbing hold assembly is able to greatly reduce the compressive forces experienced in securing a climbing hold to a panel or sheet of polycarbonate or thermoplastic material. A region of a load dissipation element formed in the underside of the load dissipation element is in communication with a region of the climbing hold formed in the underside of the climbing hold via the polycarbonate or thermoplastic material, the regions being of substantially the shape.

17 Claims, 11 Drawing Sheets

SECTION "A-A"

CLIMBING HOLD ASSEMBLY HAVING LOAD DISSIPATIVE EFFECT

PRIORITY CLAIM

This application claims priority to U.S. Provisional Patent Application No. 61/816,246 filed Apr. 26, 2013, which is hereby incorporated herein by reference.

BACKGROUND

Polycarbonate or thermoplastic panels used in climbing walls and the likes may experience cracking. A climbing panel, while extremely strong and durable, may be subject to radial stress cracks specifically located around the edge of a hole pre-drilled in the panel, which is used to affix a climbing hold to the panel of the climbing structure.

The current method of attaching climbing holds to polycarbonate or thermoplastic sheet that form the panels of a climbing surface is to use a combination of a bolt, flat and locking washers, and either a nut, an embedded nut ('T' Nut) or a threaded insert. When attaching the climbing hold the assembler needs to exert sufficient torque on the bolt creating compressive forces between the climbing hold and the panel in order to prevent the climbing hold from spinning. The majority of compressive forces exerted on the panel, using the current method, are located immediately around the edges of the pre-drilled hole in the panel and this dramatically increases the possibility of the panel cracking or fracturing in a Tangential/Radial direction away from the hole. Coupled with the live load exerted on the climbing hold by a climber, these radial cracks or fractures have the potential to extend and creep into a full crack, not dissimilar to that of a cracked windshield.

Such radial cracks or fractures may not be immediately detectable, particularly if the climbing hold or the hardware used to affix a climbing hold to the panel obscures them. They are, nonetheless, serious in that the integrity of the panel is compromised, potentially worsens over time with live stress loads, and cannot be repaired.

BRIEF DESCRIPTION OF THE DRAWINGS

Example embodiments of the present disclosure will be described below with reference to the included drawings such that like reference numerals refer to like elements and in which.

DETAILED DESCRIPTION

Figure 1A:
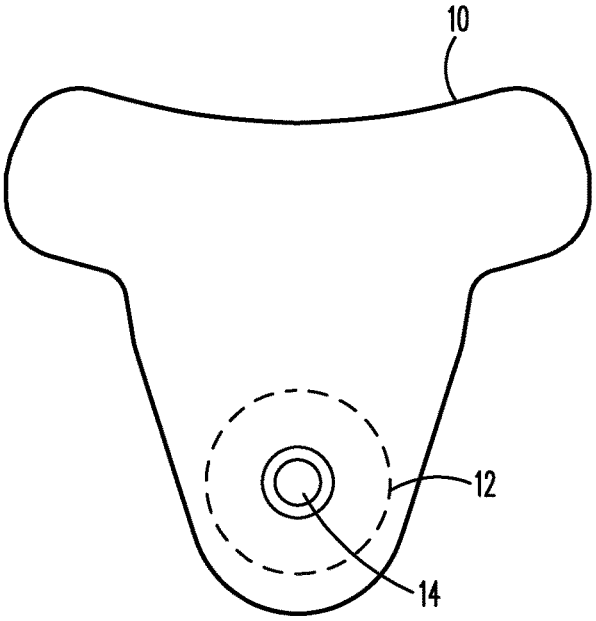
FIGS. 1*a* and 1*b* illustrate is an example of a climbing hold or handhold, consistent with certain implementations.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically. Reference throughout this document to "one embodiment", "certain embodiments", "an embodiment", "an example", "an implementation", "an example" or similar terms means that a particular feature, structure, or characteristic described in connection with the embodiment, example or implementation is included in at least one embodiment, example or implementation of the present invention. Thus, the appearances of such phrases or in various places throughout this specification are not necessarily all referring to the same embodiment, example or implementation. Furthermore, the particular features, structures, or characteristics may be combined in any suitable manner in one or more embodiments, examples or implementations without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

In accordance with the various embodiments described herein there is provided an assembly that serves to dissipate the compressive forces experienced by panels, such as climbing panels, affixed to a climbing apparatus, such as a climbing scaffold that provides structure support and shape for a climbing wall or climbing feature. A problem in the art experienced with panels made of polycarbonate or thermoplastic sheet is that, while extremely strong and durable, compressive forces experienced in the panel material can produce fracturing and cracking directly around the edge of a pre drilled hole in the panel, particularly where hardware is placed through the hole to affix a climbing hold to the panel. The use of load dissipation elements with a cavity, such as a load dissipation nut, a load dissipation plate, and a cavity backed climbing hold, in a climbing hold assembly serves to dissipate these compressive forces away from the hole location in the panel and thus greatly reduces or eliminates fractures and cracking in the panel. The climbing hold assembly dissipates compressive stress from the hole location and dissipates the load over a greater surface area of the panel. In this way, compressive forces are distanced away from the drilled hole location. In certain embodiments, the compressive forces are distanced away from the drilled hole edges by a minimum of 1× the diameter of the drilled hole, thereby being in compliance with safety recommendation of polycarbonate sheet manufacturers. It is noted that the distance by which compressive forces are displaced away from the drilled hole edges may change with improvements in material science, as may the safety recommendations of panel manufacturers, without departing from the scope of the embodiments presented herein.

A climbing hold assembly in accordance with the present teachings may include a climbing hold and a load dissipation element with a cavity, a bolt, a neoprene washer, a flat steel washer and nut, or the like. In a method of assembly, the climbing hold is affixed to a polycarbonate or thermoplastic sheet or panel by placing a bolt through the climbing hold, the sheet or panel of polycarbonate or thermoplastic material, an optional neoprene washer, the load dissipation element with cavity, the bolt being tightened into place with the necessary torque. A cavity formed in the underside of the handhold that rests against the polycarbonate panel is in communication with a corresponding cavity on the underside of the load dissipation element that makes contact with the polycarbonate panel. The dimensions of the cavity of the climbing hold approximate that of the dimensions of the cavity of the load dissipation element, with the dimensions of the cavity of the load dissipation element being at least three times that of the diameter of the hole through the polycarbonate material. Thus, as an example, in an application in which the hole through the polycarbonate material is ¼ inch, the cavity in the load dissipation element will be at least ¾ inch and will approximate the size and shape, or volume, of the cavity of the climbing hold.

Thus, marrying the dimensions of the cavities of the climbing hold and the load dissipation element is useful for reducing or even eliminating the compressive forces experienced by the climbing hold assembly, directly at the edges of the pre drilled hole so as to prevent or greatly reduce the occurrence of radial cracking in the polycarbonate or thermoplastic panel.

Figure 1B:
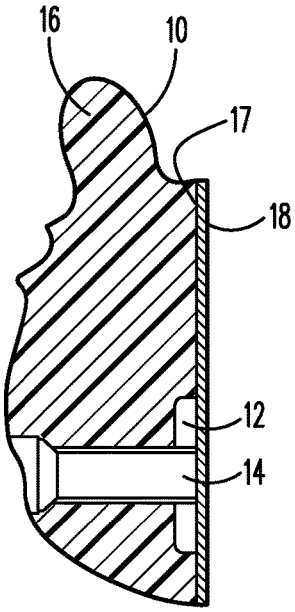

An example handhold or climbing hold is illustrated in FIGS. 1*a* and 1*b*, in which both top and cross-sectional views are shown. In the top view of FIG. 1*a*, climbing hold 10 is shown with a cavity in the underside (on the bottom) of climbing hold 10, as indicated by the dashed lines. Also illustrated is hole 14 in the climbing hold through which a fastening element may pass to affix or fasten the climbing hold to a panel or sheet of material. Hole 14 in this particular embodiment is shown centered in the middle of cavity 12, though in other embodiments hole 14 need not be centered in cavity 12 so long as it located within the cavity 12 to allow a fastening element to pass through the cavity 12 in the underside of climbing hold 10. In the cross-sectional view of climbing hold 10 in FIG. 1*b*, it can be seen that the body of the climbing hold is formed of material 16. Cavity 12 is formed in the underside of the climbing hold and the outline of the cavity 12 in the bottom surface 17 of climbing hold 10 has a shape, in this instance a circular shape as can be seen in the dashed lines in FIG. 1*a*. Cavity 12 may be considered a region of the climbing hold formed in the underside of the climbing hold as shown, with the region being the absence of material or cavity. Optionally, climbing hold 10 may have a backing 18 on the bottom of surface 17 of a softer material than the material 16 of the climbing hold body to cushion the mating of climbing hold 18 to a panel in a climbing hold assembly and to, importantly, inhibit rotation of the climbing hold when torque forces are applied to the fastening element during assembly of the climbing hold assembly. Alternately, soft backing 18 may be a softer portion of the bottom surface of climbing hold 18 and not a backing separate from the body of the climbing hold 10.

Other examples of climbing handholds can be seen in FIGS. 4, 6, 9 and 10. The size, shape, dimensions and materials of climbing handholds can and do vary widely. For example, while the cavity 12 is shown as being circular in shape in the bottom surface 17 of the climbing hold, the shape of the cavity at the bottom surface 17 may be any shape in the bottom surface of the climbing hold through which a fastening element may pass through hole 14 to fasten the climbing hold to a panel. The cavity of the handhold can be clearly seen in the views in the drawings, and as will be also illustrated in the climbing hold assemblies in FIGS. 9 and 10 the dimensions of the cavity of the climbing hold will be approximated by the dimensions of the cavity of the load dissipative element mated or aligned with it via the panel in the assembly.

Figure 2A:
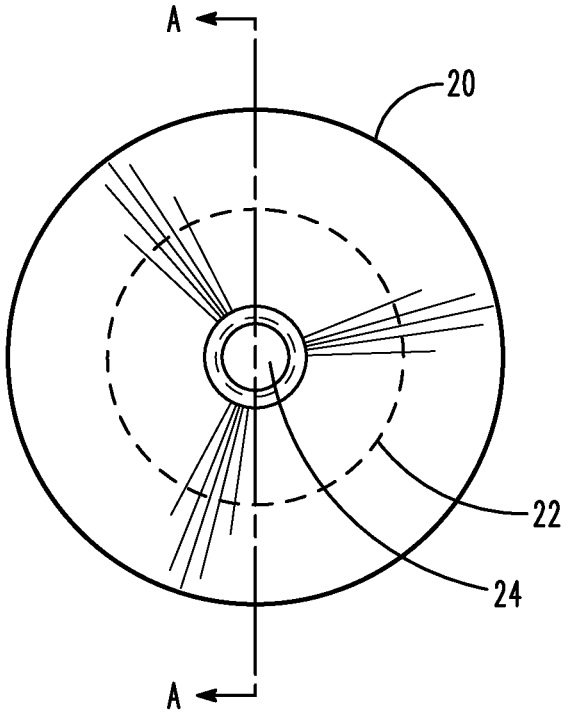
FIGS. 2*a* and 2*b* illustrate a top view and a cross-sectional view of an exemplary load dissipation nut with cavity, consistent with certain embodiments.
Figure 2B:
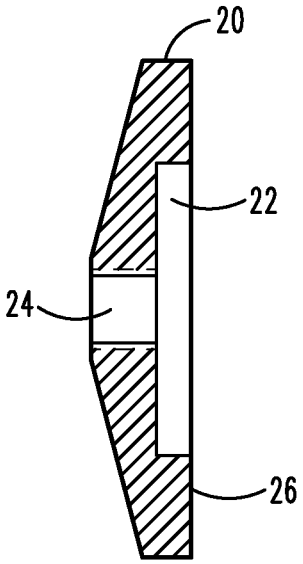
Figure 3A:
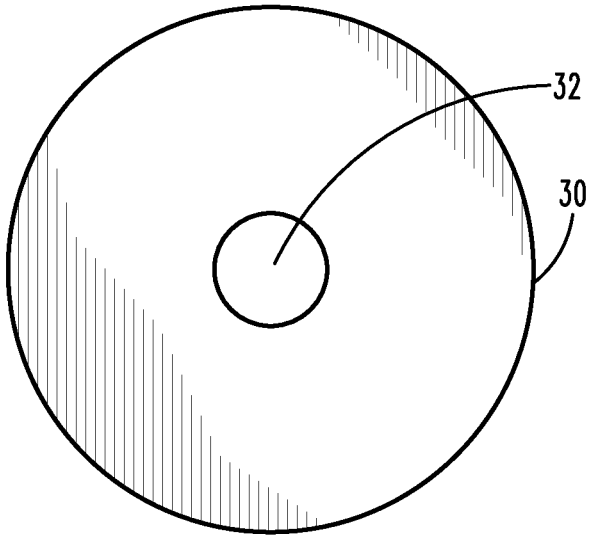
FIGS. 3*a* and 3*b* illustrate top and isometric views of a neoprene washer, consistent with certain embodiments.
Figure 3B:
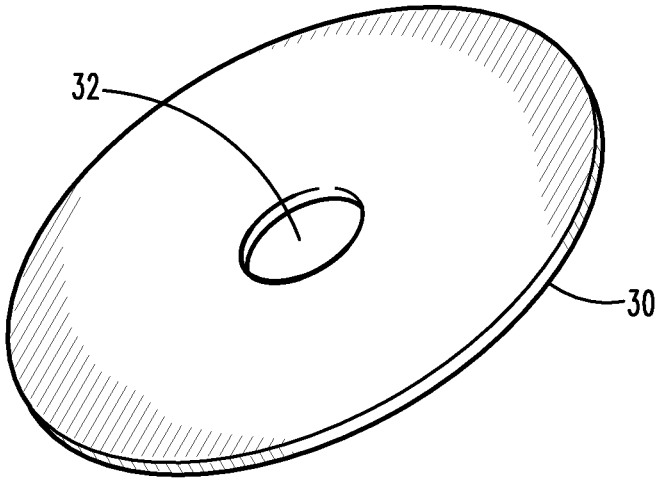
Figure 9:
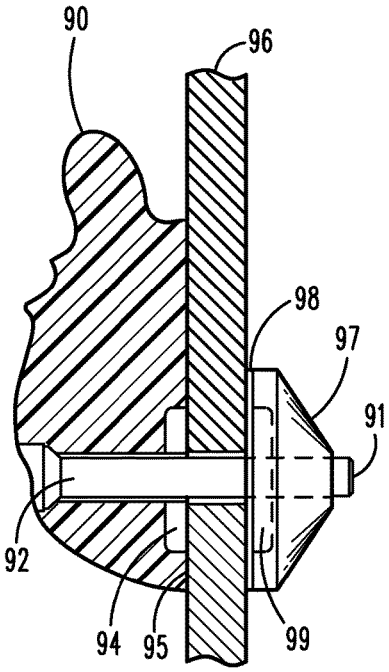
FIG. 9 illustrates a cross-sectional view of a load dissipation assembly that employs a load dissipation nut, consistent with certain embodiments.

As previously mentioned, the load dissipation element may be a load dissipation nut or a load dissipation plate, and both types in certain embodiments will have a cavity with a dimension that approximates that of the cavity of the handhold to which it is mated or aligned via the panel in a climbing hold assembly. In FIGS. 2*a* and 2*b*, top and cross-sectional views of a load dissipation nut 20 are shown with a cavity 22. Cavity 22 may be considered a region formed in the underside of the load dissipation nut as shown, with the region being the absence of material or cavity. The dimensions, including size and shape, or volume, of the load dissipation nut cavity 20 will match or approximate that of the cavity of the climbing hold to which is it coupled, as shown in FIG. 9, for example; in this case, the shape of cavity 22 is circular although other sizes and shapes could be used. For instance, the circular cavity of the load dissipation nut may have a diameter of 1.5 and the climbing hold cavity may also be circular with a diameter of 1.5 or closely to 1.5. FIG. 2*a* illustrates the top view of the load dissipation nut; the bottom surface 26 of the load dissipation nut will be in contact with either the polycarbonate or thermoplastic material of the panel or optionally a neoprene washer 30 with hole 32 shown in the top and isometric views of FIGS. 3*a* and 3*b*, respectively. In this example, the load dissipation nut is threaded to accommodate a bolt or other fastening element that passes through hole 24 and is used to secure the load dissipation nut to the polycarbonate panel and climbing hold. While the washer of FIGS. 3*a* and 3*b* is referred to as a neoprene washer, this is but one example of a suitable material. For example, other flexible types of material, such as urethane may be used as well.

Figure 11A:
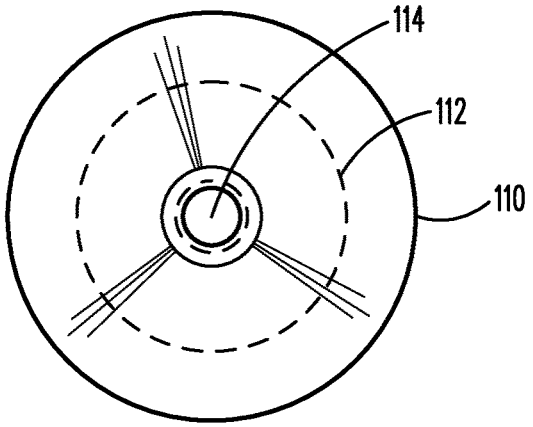
FIGS. 11*a*, 11*b*, and 11*c* illustrate top, cross-sectional, and isometric views of an illustrative load dissipation nut, consistent with certain embodiments.
Figure 11B:
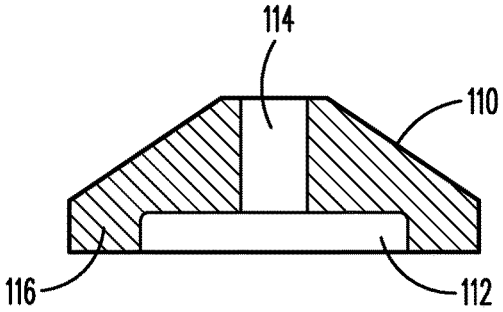
Figure 11C:
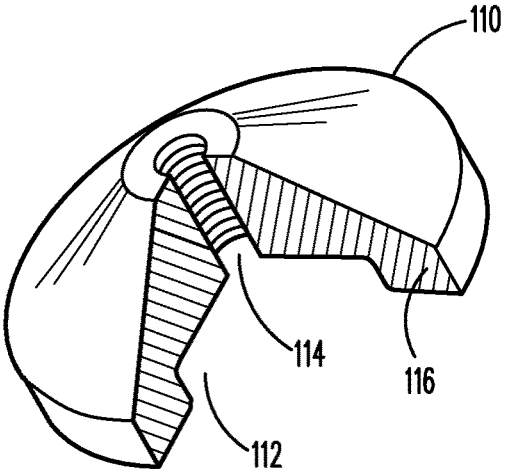

A further illustration of a load dissipation nut is found in FIGS. 11*a*, 11*b*, and 11*c*, in which top, cross-sectional, and isometric cut-away views of an example threaded load dissipation nut are shown. In the top view of FIG. 11*a*, load dissipation nut 110 is shown with a threaded hole 114 which can accommodate a fastening element that passes therethrough. A cavity 112 is formed in the underside of load dissipation nut 110. In the cross-sectional view of FIG. 11*b*, it can be seen that the nut is formed of a material 116 that surrounds the cavity 112 formed in the underside of nut 110. In the cut-away isometric new of nut 110 in FIG. 11*c*, the threaded hole 114 and the shape of cavity 112 is clearly illustrated.

As previously mentioned, in certain embodiments the dimensions of the cavity of the load dissipation element may be at least approximately three times that of the dimension of the hole through the polycarbonate panel material. So, in this example, the diameter of the hole through the polycarbonate sheet may be 0.438 while the diameter of the cavity of the load dissipation nut is at least three times that, or 1.5. Similarly, in certain embodiments, the dimensions of the cavity of the climbing hold may be at least approximately three times that of the dimension of the hole through the panel material. It is noted that the dimensions of either the climbing hold or the load dissipation element in the assembly with respect to the dimensions of the through hole in the panel may change with improvements in material science, without departing from the scope of the embodiments presented herein.

For climbing walls and apparatus used in an aquatic environment, metals that are non-ferrous, such as stainless steel, brass, bronze, aluminum, etc. may be used to produce the load dissipation element, alternatively high strength plastic materials such as Ultem and pultruded fiberglass may be used.

Figure 4:
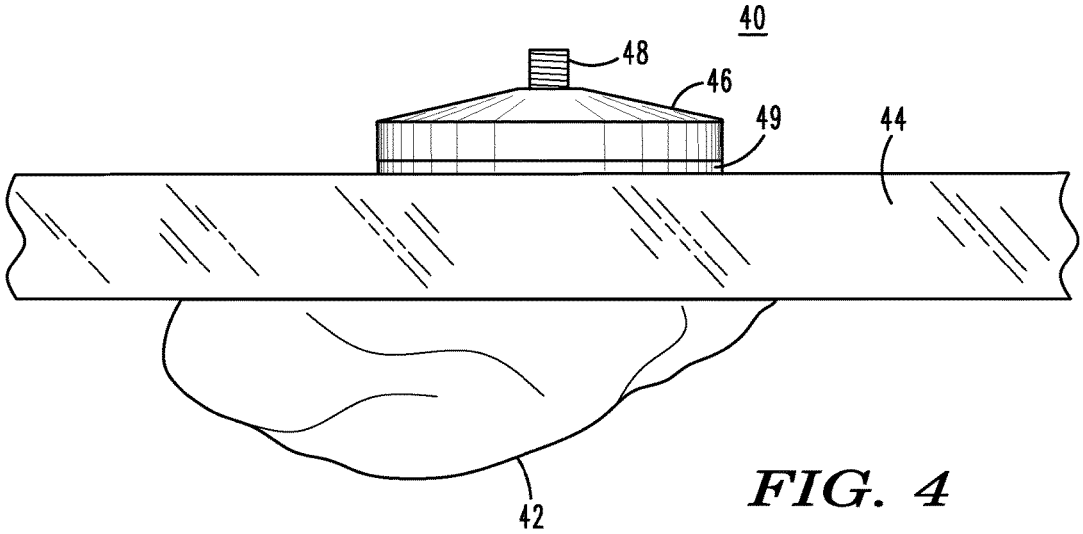
FIG. 4 is a side view of a climbing hold assembly, consistent with certain embodiments.
Figure 5:
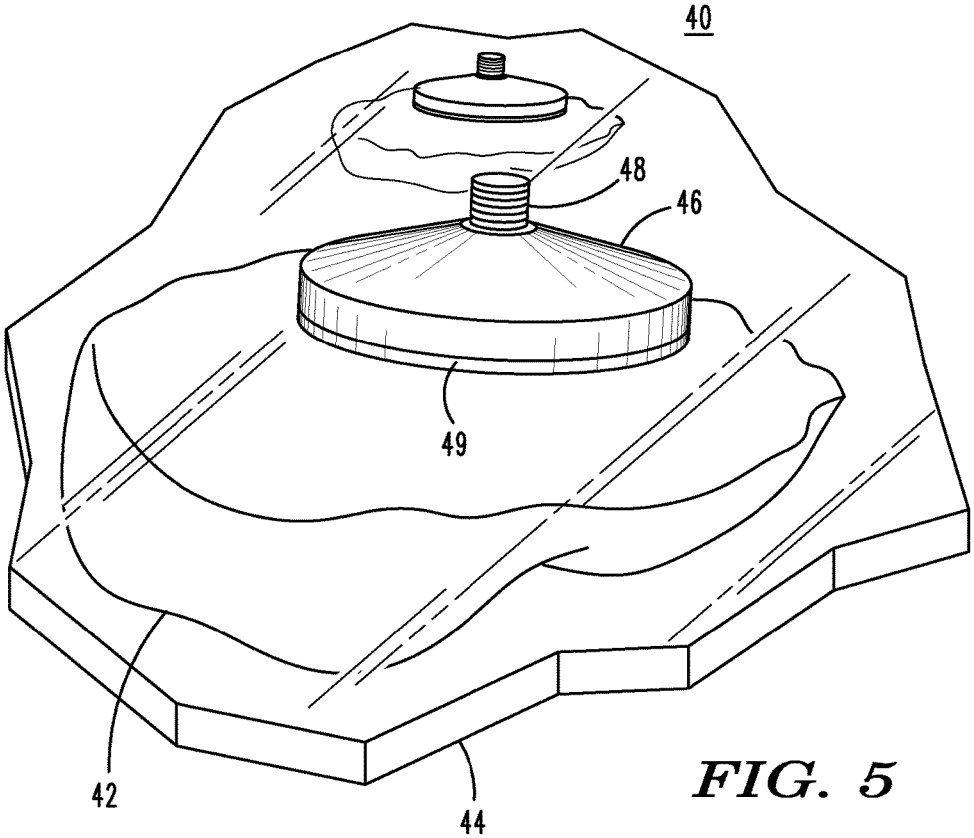
FIG. 5 is a perspective view of a climbing hold assembly, consistent with certain embodiments.

FIGS. 4-5 illustrate various views of a load dissipation assembly in use. FIG. 4 is a side view of a climbing hold assembly 40, with the climbing hold 42 on the bottom of panel 44 and the load dissipation element 46 on top of the panel 42. The entire assembly is coupled together with a fastening element, such as a bolt or screw 48, or other fastening element, shown at the top of the assembly. Also shown in the optional neoprene washer 49. FIG. 5 offers a perspective view of the climbing hold assembly 40, in which, again, the load dissipation element is shown on top of the polycarbonate panel. The panel 44 is of a clear or see-through material such that the climbing hold 42 fastened to the bottom surface of panel 44 is seen.

Figure 6B:
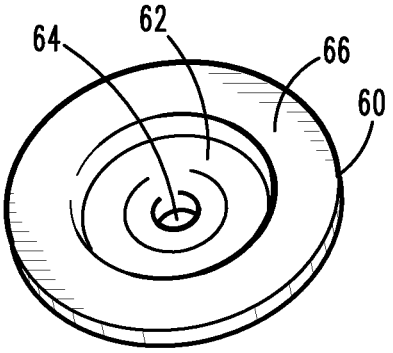
FIGS. 6*a*-6*c* illustrates a disassembled load dissipation assembly, in which a cavity formed in an underside of a climbing hold, a cavity of an underside of a load dissipation element, and a top side of the load dissipation element can be seen, consistent with certain embodiments.
Figure 6C:
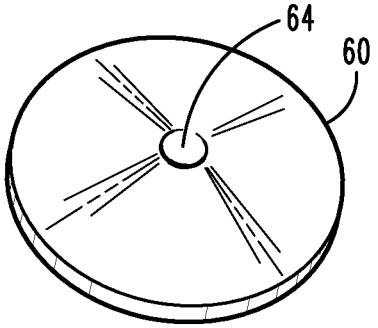
Figure 6A:
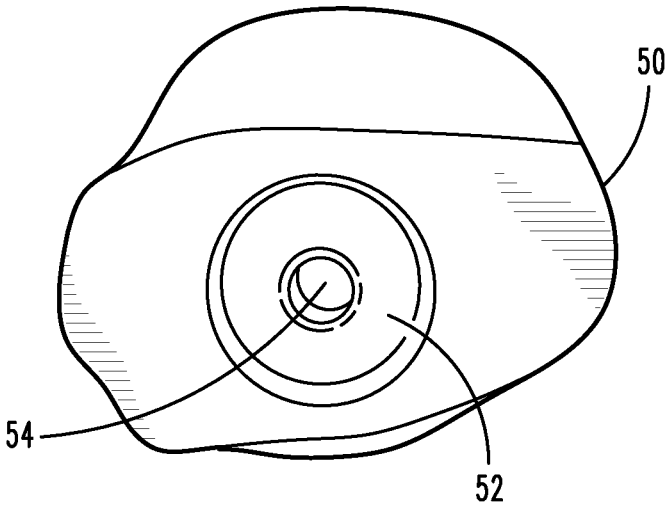

FIGS. 6*a*-6*c* illustrate a disassembled load dissipation assembly, minus the fastening element bolt or screw, in which a cavity formed in an underside of a climbing hold in FIG. 6*a*, a cavity of an underside of a load dissipation element in FIG. 6*b*, and a top side of the load dissipation element can be seen in FIG. 6*c*. In the bottom view of climbing hold 50, the region formed in the underside of the climbing hold is a cavity 52, circular in shape. Hole 54 of climbing hold 50 passes through the cavity and body portion of the hold as shown. In the bottom perspective view of load dissipation nut 60 of FIG. 6*b*, the bottom surface 66 is shown and it can be seen that the shape of the cavity 62 formed in the bottom surface is circular. Again, the shape of the cavity 62 at the bottom surface 66 may be any shape in the bottom surface of the load dissipation nut through which a fastening element may pass through hole 64 to fasten the load dissipation nut to a surface of a panel. In the top perspective view of FIG. 6*c*, load dissipation nut 60 with hole 64 is shown.

As previously discussed, the load dissipation element may also be a load dissipation plate (or washer) that would, again, have a cavity region of the load dissipation element configured to mate with a corresponding cavity region of a climbing hold to which it is coupled in a load dissipation assembly. To do this, the size and shape dimensions, or volume, of the cavity of the load dissipation plate will approximate those of the cavity of the climbing hold. The load dissipation plate may be pressed steel or stainless steel with cavity or it may be a load dissipation plate with cavity that can be made of numerous other materials employed without departing from the scope described herein.

Figure 7C:
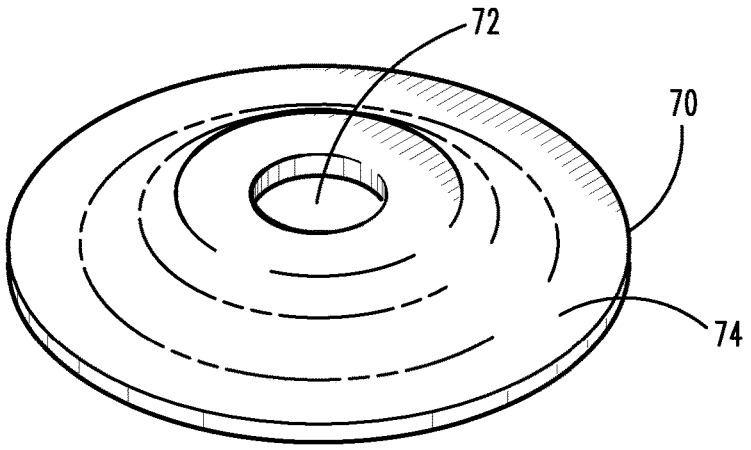
FIGS. 7*a*, 7*b*, and 7*c* illustrate top, cross-sectional, and isometric views of a load dissipation plate with cavity, consistent with certain embodiments.
Figure 7A:
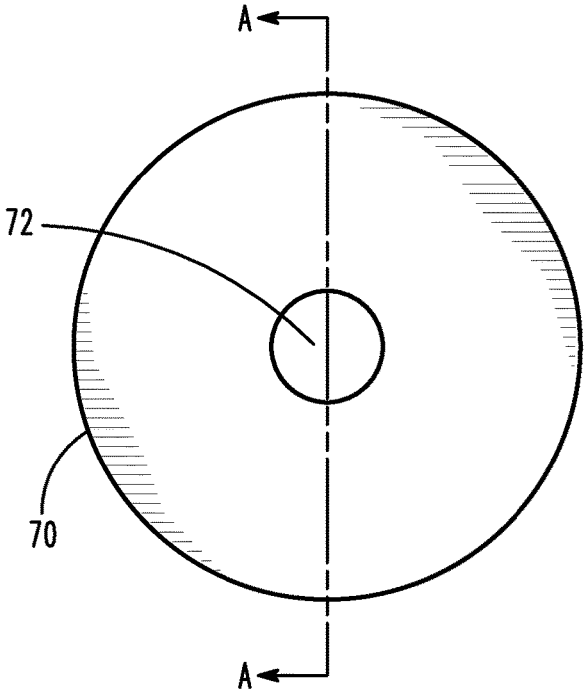
Figure 7B:
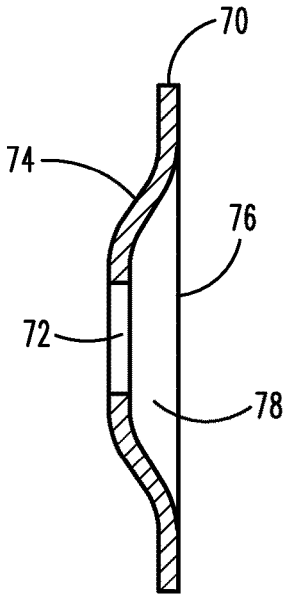

An example of a pressed load dissipative plate 70 with hole 72, cavity 78 and bottom surface 76 is illustrated in FIGS. 7*a*, 7*b*, and 7*c*, in which top, cross-sectional, and isometric views are shown. Unlike the load dissipation nut of FIGS. 2 and 3, in this example the load dissipative plate is not threaded.

Figure 8:
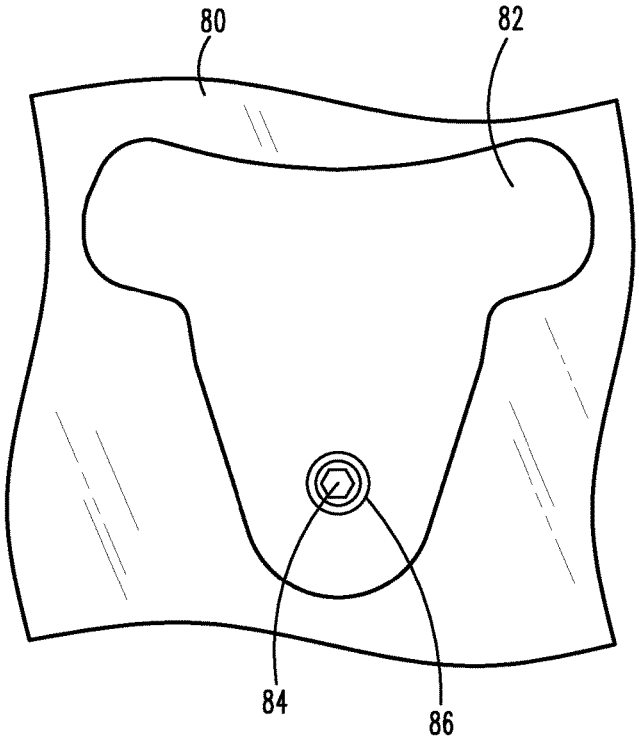
FIG. 8 illustrates a top view of a climbing hold affixed to a panel, consistent with certain embodiments.

In FIG. 8 a top view of a polycarbonate panel 80 is shown with a hand hold or climbing hold 82 affixed to it. As discussed above, the hold is attached to the polycarbonate panel by a screw, bolt or other fastening device or element 84 that passes through a hole 86 of the climbing hold, a hole in the panel and mates with a load dissipation element affixed to the bottom surface of the panel, to create a load dissipation assembly.

Figure 10:
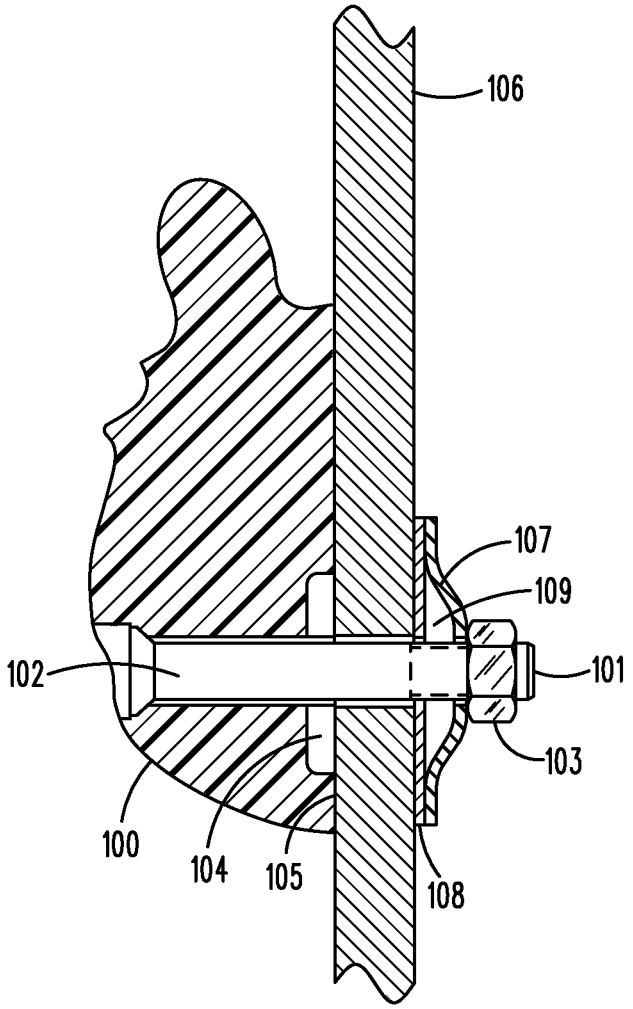
FIG. 10 illustrates a cross-sectional view of a load dissipation assembly that employs a load dissipation plate, consistent with certain embodiments.

Two such assemblies are illustrated in FIGS. 9 and 10. In the cross-sectional view FIG. 9, the load dissipation assembly includes the climbing hold 90, a fastening element 91 that passes through the hold, a hole in the panel and mates with a load dissipation nut 97 having a bottom region 98 affixed to the bottom surface 95 of the panel 96. The cavity region 94 of the hold 90 and the cavity region 99 of the load dissipation nut 97 are approximately the same size and shape, or volume, as shown. The load dissipation nut 97 resembles that illustrated in FIGS. 2 and 3 and has a generally conical shape as shown. As will be illustrated in later drawings FIGS. 12, 13 and 14, the region formed in the underside of the climbing hold as well as the region formed in the underside of the load dissipation nut in the climbing hold assembly may be either a cavity region or a region of softer material characterized as having a measure of hardness, such as a Durometer rating, that is less than that of the material that surrounds and is contiguous the region of softer material. Examples of softer material for the regions formed in the underside of the climbing hold and/or the underside of the load dissipation element include natural sponge, rubber, polystyrene rubber, silicon sealant, silicon, paste, beads, etc.

FIG. 10 shows a cross-sectional view of a load dissipation assembly that includes a load dissipation plate 107 coupled to a climbing hold 100 through a bolt, screw or other fastening device 101, passed through a hole 102 in the hold, a hole in the panel and the load dissipation plate 107 and affixed to the bottom surface 106 of the panel using an optional flat washer 108, and locking nut 103 as shown. Again, the cavity of the hold and the cavity of the load dissipation plate are approximately the same size and shape, or volume, as shown. The load dissipation plate resembles that illustrated in FIGS. 7*a*-7*c*. As will be illustrated in later drawings FIGS. 15, 16 and 17, the region formed in the underside of the climbing hold as well as the region formed in the underside of the load dissipation plate in the climbing hold assembly may be either a cavity region or a region of softer material characterized as having a measure of hardness, such as a Durometer rating, that is less than that of the material that surrounds and is contiguous the region of softer material.

Figure 12:
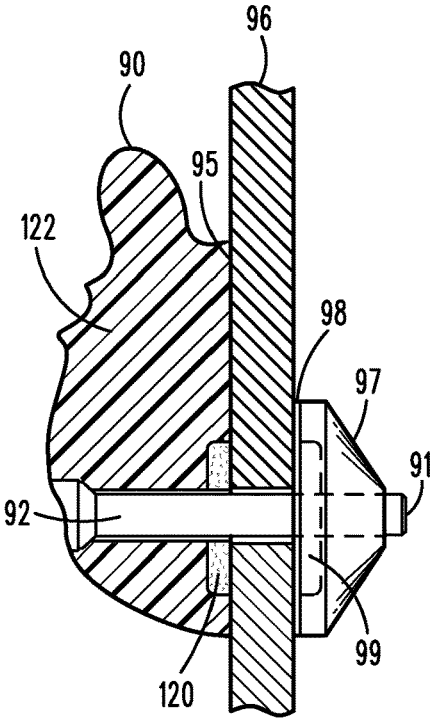
FIGS. 12, 13 and 14 illustrate cross-sectional views of climb hold assemblies that employ a load dissipation nut, consistent with certain further embodiments.
Figure 13:
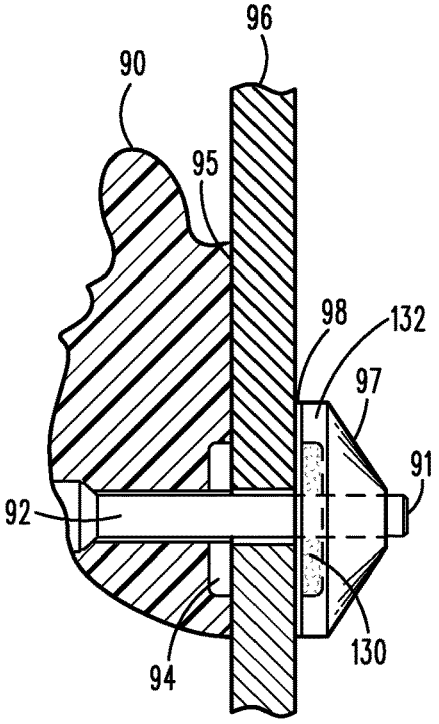
Figure 14:
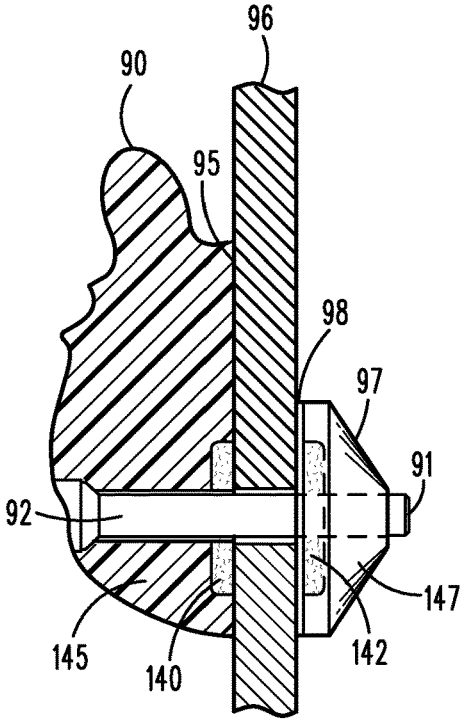

Referring now to FIGS. 12, 13, and 14, it can be seen that in a climbing hold load dissipation assembly comprised of a climbing hold 90, a panel 96 and a load dissipation nut 97, that the regions formed in the underside of the climbing hold and in the underside of the load dissipation nut may be either a cavity region and/or a region of softer material. In FIG. 12, climbing hold 90 has a region 120 of softer material having a measure of hardness that is less than a measure of hardness of material 122 of the body of climbing hold 90 that surrounds and is contiguous the region 120, as shown. In the particular example embodiment of FIG. 12, the region formed in the underside of load dissipation nut 97 is a cavity region 99 as shown in FIG. 9. In FIG. 13, the cavity region 94 formed in the underside of climbing hold 90 is as shown in FIG. 9. The region 130 formed in the underside of load dissipation nut 97, however, is of a material characterized by a measure of hardness that is less than a measure of hardness of material 132 of load dissipation nut that surrounds and is contiguous region 130, as shown. In FIG. 14, both underside regions 140 and 142 are regions having material that is softer than the material that surrounds and is contiguous them. So, for example, region 140 formed in the underside of hold 90 is surrounded by material 145 of hold 90 that is harder than the material in region 140. Similarly, the region 142 formed in the underside of load dissipation nut 97 is surrounded by material 147 that is harder than the material in region 142. The measure of hardness of the material in regions 140 and 142 may be approximately the same or they may differ from each other in their Durometer rating. In each of the climbing hold example assemblies shown in FIGS. 12-14, the shape of the region in the bottom surface of the climbing hold and the shape of the region in the bottom surface of the load dissipation are approximately the same so that compressive forces introduced by applying torqueing forces to assembly the climbing hold assembly to the panel 96 are dissipated away from the panel through hole as has been described.

Figure 15:
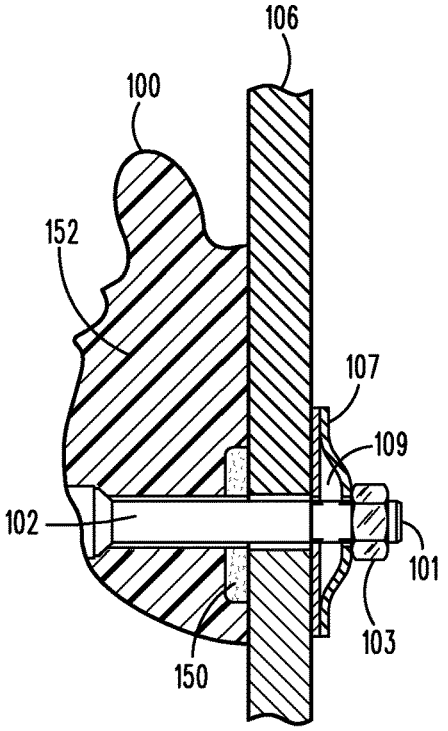
FIGS. 15, 16 and 17 illustrate cross-sectional views of climb hold assemblies that employ a load dissipation plate, consistent with certain further embodiments.
Figure 16:
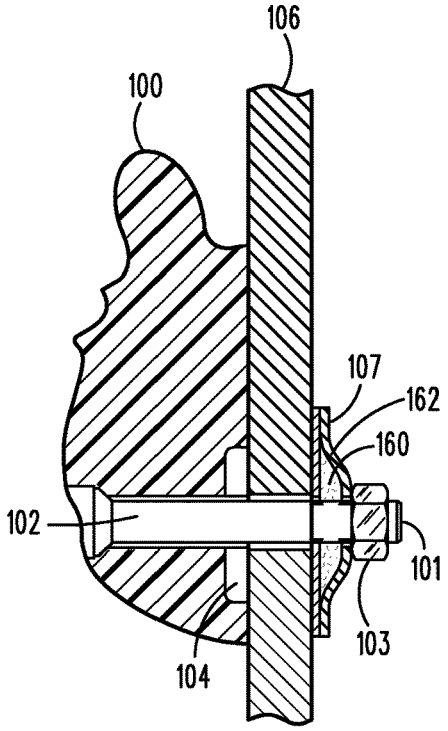
Figure 17:
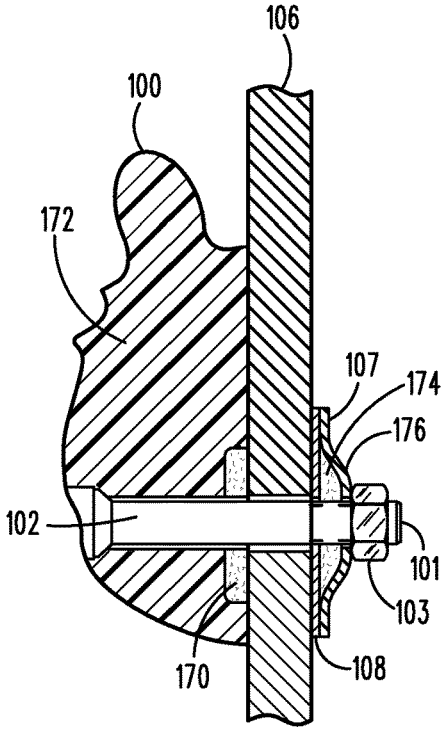

Referring now to FIGS. 15, 16, and 17, it can be seen that in a climbing hold load dissipation assembly comprised of a climbing hold 100, a panel 106 and a load dissipation nut 107, that the regions formed in the underside of the climbing hold and in the underside of the load dissipation nut may be either a cavity region and/or a region of softer material. In FIG. 15, climbing hold 100 has a region 150 of softer material having a measure of hardness that is less than a measure of hardness of material 152 of the body of climbing hold 100 that surrounds and is contiguous the region 150, as shown. In the particular example embodiment of FIG. 12, the region formed in the underside of load dissipation nut 107 is a cavity region 109 as shown in FIG. 10. In FIG. 16, the cavity region 104 formed in the underside of climbing hold 100 is as shown in FIG. 10. The region 160 formed in the underside of load dissipation nut 107, however, is of a material characterized by a measure of hardness that is less than a measure of hardness of material 162 of load dissipation nut that surrounds and is contiguous region 160, as shown. In FIG. 17, both underside regions 170 and 172 are regions having material that is softer than the material that surrounds and is contiguous them. So, for example, region 170 formed in the underside of hold 100 is surrounded by material 172 of hold 100 that is harder than the material in region 170. Similarly, the region 174 formed in the underside of load dissipation nut 107 is surrounded by material 176 that is harder than the material in region 174. The measure of hardness of the material in regions 170 and 174 may be approximately the same or they may differ from each other in their Durometer rating. In each of the climbing hold example assemblies shown in FIGS. 15-17, the shape of the region in the bottom surface of the climbing hold and the shape of the region in the bottom surface of the load dissipation are approximately the same so that compressive forces introduced by applying torqueing forces to assembly the climbing hold assembly to the panel 106 are dissipated away from the panel through hole as has been described.

The implementations of the present disclosure described above are intended to be examples only. For example, while polycarbonate or thermoplastic panels are discussed, the panels may additionally be made of glass or other suitable material. Those of skill in the art can effect alterations, modifications and variations to the particular example embodiments herein without departing from the intended scope of the present disclosure. Moreover, selected features from one or more of the above-described example embodiments can be combined to create alternative example embodiments not explicitly described herein.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

What is claimed is:

1. A climbing hold assembly, comprising:

a climbing hold comprising a top surface for gripping by a climber and a bottom surface opposing the top surface, the bottom surface structurally configured for mating with a first side of a panel;

a first cavity disposed in the bottom surface of the climbing hold, the first cavity adjacent to the first side of the panel when the climbing hold assembly is mounted to the panel;

a first hole passing through the climbing hold, the first hole comprising an opening within the first cavity;

a load dissipation element comprising an underside structurally configured for mating with a second side of the panel, where the second side of the panel is disposed opposite the first side of the panel;

a second cavity disposed in the underside of the load dissipation element and having a shape that approximates a shape of the first cavity, the second cavity adjacent to the second side of the panel when the climbing hold assembly is mounted to the panel;

a second hole passing through the load dissipation element, the second hole comprising an opening within the second cavity, where the first hole and the second hole are configured for alignment with a third hole disposed through the panel; and a fastening element configured to pass through the first hole, the second hole, and the third hole to fasten the climbing hold to the first side of the panel and the load dissipation element to the second side of the panel, the fastening element thereby configured to extend through each of the first cavity and the second cavity and to opposedly align the first cavity with the second cavity on the first and second sides of the panel, where the shape of each of the first cavity and the second cavity is circular and where a diameter of each of the first cavity and the second cavity is at least three times larger than a diameter of the third hole disposed through the panel.

2. The climbing hold assembly of claim 1, where the fastening element is structurally configured to mount the climbing hold assembly to the panel responsive to torque forces applied to the fastening element.

3. The climbing hold assembly of claim 2, where the fastening element comprises a bolt or a screw.

4. The climbing hold assembly of claim 1, where a size of the first cavity approximates a size of the second cavity.

5. The climbing hold assembly of claim 1, where a size and shape of the first cavity approximates a size and shape of the second cavity.

6. The climbing hold assembly of claim 1, where a volume of the first cavity approximates a volume of the second cavity.

7. The climbing hold assembly of claim 1, further comprising a backing on the bottom surface of the climbing hold such that the backing is disposed between the bottom surface and the panel when the climbing hold assembly is mounted to the panel.

8. The climbing hold assembly of claim 1, further comprising a washer disposed on the underside of the load dissipation element such that the washer is disposed between the underside and the panel when the climbing hold assembly is mounted to the panel.

9. The climbing hold assembly of claim 1, where at least one of a size, a shape, or a volume of the first cavity is different than that of the second cavity.

10. The climbing hold assembly of claim 1, where the load dissipation element comprises a load dissipation plate.

11. The climbing hold assembly of claim 1, where the load dissipation element is formed of one or more of stainless steel, brass, bronze, aluminum, plastic, structural plastic, plastic pultruded fiberglass, neoprene, and urethane.

12. The climbing hold assembly of claim 1, where the fastening element is structurally configured to fasten each of the climbing hold and the load dissipation element directly to the panel.

13. A climbing hold assembly, comprising:

a climbing hold comprising a top surface for gripping by a climber and a bottom surface opposing the top surface, the bottom surface structurally configured for mating with a first side of a panel;

a first cavity disposed in the bottom surface of the climbing hold, the first cavity adjacent to the first side of the panel when the climbing hold assembly is mounted to the panel;

a first hole passing through the climbing hold, the first hole comprising an opening within the first cavity;

a load dissipation element comprising an underside structurally configured for mating with a second side of the panel, where the second side of the panel is disposed opposite the first side of the panel, where the load dissipation element comprises a threaded load dissipation nut;

a second cavity disposed in the underside of the load dissipation element, the second cavity adjacent to the second side of the panel when the climbing hold assembly is mounted to the panel;

a second hole passing through the load dissipation element, the second hole comprising an opening within the second cavity, where the first hole and the second hole are configured for alignment with a third hole disposed through the panel; and a fastening element configured to pass through the first hole, the second hole, and the third hole to fasten the climbing hold to the first side of the panel and the load dissipation element to the second side of the panel, the fastening element thereby configured to extend through each of the first cavity and the second cavity and to opposedly align the first cavity with the second cavity on the first and second sides of the panel.

14. A climbing hold assembly, comprising:

a climbing hold comprising a top surface for gripping by a climber and a bottom surface opposing the top surface, the bottom surface structurally configured for mating with a first side of a panel;

a first cavity disposed in the bottom surface of the climbing hold;

a load dissipation element comprising an underside structurally configured for mating with a second side of the panel, where the second side of the panel is disposed opposite the first side of the panel;

a second cavity disposed in the underside of the load dissipation element and having a shape that approximates a shape of the first cavity; and a hole disposed entirely through the climbing hold and the load dissipation element, the hole thereby extending through each of the first cavity and the second cavity and positioned for opposedly aligning the first cavity with the second cavity on the first and second sides of the panel when a fastening element is passed through the hole, where the shape of each of the first cavity and the second cavity is circular and where a diameter of each of the first cavity and the second cavity is at least three times larger than a diameter of the hole extending through the first and second cavities.

15. The climbing hold assembly of claim 14, further comprising the fastening element configured to pass through a panel hole disposed through a panel as well as the hole in each of the climbing hold and the load dissipation element, the fastening element thereby configured to mount the climbing hold assembly to the panel.

16. The climbing hold assembly of claim 15, where the fastening element mounts the climbing hold assembly to the panel responsive to torque forces applied to the fastening element.

17. The climbing hold assembly of claim 15, where the fastening element opposedly aligns the first cavity with the second cavity on opposing the first and second sides of the panel.

* * * * *